United States Patent [19]

Steimle

[11] 4,148,234

[45] Apr. 10, 1979

[54] TOOL KIT FOR SERVICING TURBO HEADS

[76] Inventor: Wayne D. Steimle, 2085 Vista, Arcadia, Calif. 91006

[21] Appl. No.: 855,207

[22] Filed: Nov. 28, 1977

[51] Int. Cl.[2] ..... B25B 9/00; A47F 13/06

[52] U.S. Cl. ..... 81/3 R; 294/19 R

[58] Field of Search ..... 81/1 R, 3 R, 90 R, 90 B, 81/90 C, 90 D, 53.1, 64; 294/19 R, 99 R

[56] References Cited

U.S. PATENT DOCUMENTS

| | | | |
|---|---|---|---|
| 2,480,366 | 8/1949 | Hewitt | 81/3 R X |
| 2,964,980 | 12/1960 | Riley et al. | 81/90 B |
| 4,075,913 | 2/1978 | Tye | 81/3 R |

*Primary Examiner*—James L. Jones, Jr.
*Assistant Examiner*—James G. Smith
*Attorney, Agent, or Firm*—Sellers and Brace

[57] ABSTRACT

Tools are provided for servicing a submerged turbo head from the deck of a swimming pool whereby (1) the indexing mechanism of the turbo head can be manually manipulated at will to any position and (2) the head unit can be detached for servicing and reinstalled.

6 Claims, 5 Drawing Figures

TOOL KIT FOR SERVICING TURBO HEADS

This invention relates to a servicing tool, and more particularly to a tool kit for servicing a swimming pool turbo head from the pool deck.

A swimming pool turbo head typically comprises a unitary assembly mounted in a recess formed in a submerged portion of a swimming pool wall and is held detachably connected to a water supply pipe by a bayonet connector. A turbo head is encircled by a ring of closely-spaced water outlet ports discharging substantially in wiping contact with a submerged surface of the pool wall to flush away foreign matter. Indexing mechanism interiorly of the turbo head responds to periodic cutoff of the water pressure to index a plunger having a single outlet to discharge the water through successive ones of the ports until the entire surface area surrounding the head has been swept clear of settlings.

The present invention provides a simple, inexpensive tool kit including a handle and a pair of tools attachable thereto by one of which a workman stationed on the pool deck may detach and reinstall the complete turbo head on the pool deck. A second tool attachable to the handle enables the workman to manipulate the indexing mechanism repeatedly independently of the time-controlled cutoff valve normally employed to interrupt the water flow momentarily. This tool can be utilized to greatly accelerate the wall flushing operation and alternatively, can be used to return the water jet to any area in need of a longer flushing cycle.

Accordingly, it is a primary object of this invention to provide a unique tool specially designed for servicing swimming pool turbo heads from a remote location, such as the pool deck.

Another object of the invention is the provision of a long handled service tool having a universal readily-separable coupling at one end and a plurality of service tools selectively attachable thereto and each designed to perform a different service operation upon a conventional swimming pool turbo head.

These and other more specific objects will appear upon reading the following specification and claims and upon considering in connection therewith the attached drawing to which they relate.

Referring now to the drawing in which a preferred embodiment of the invention is illustrated:

Figure 1:
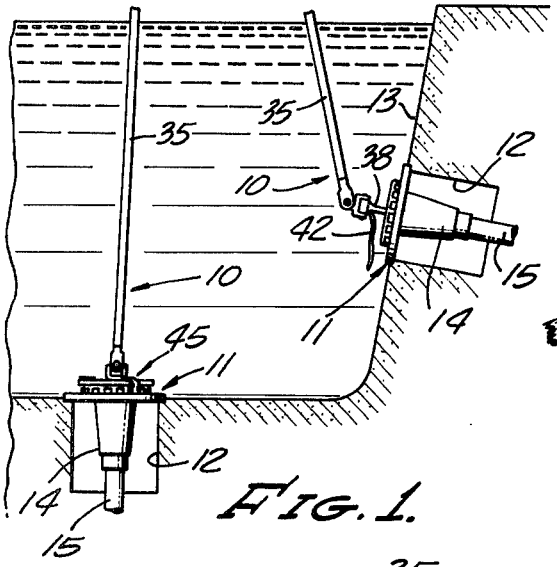
FIG. 1 is a fragmentary cross-sectional view through a swimming pool showing two turbo heads mounted in the wall and a different service tool in use with each.

Referring more particularly to FIG. 1, there is shown the invention service tool 10 in use on identical turbo heads 11,11. Each head is mounted in a recess 12 of the pool wall 13 and includes a frusto conical housing 14 permanently fixed at its smaller end to a pressurized water supply pip 15. The turbo head proper 10 nests into housing 14 and is held detachably coupled thereto by bayonet connector to be described presently.

Figure 2:
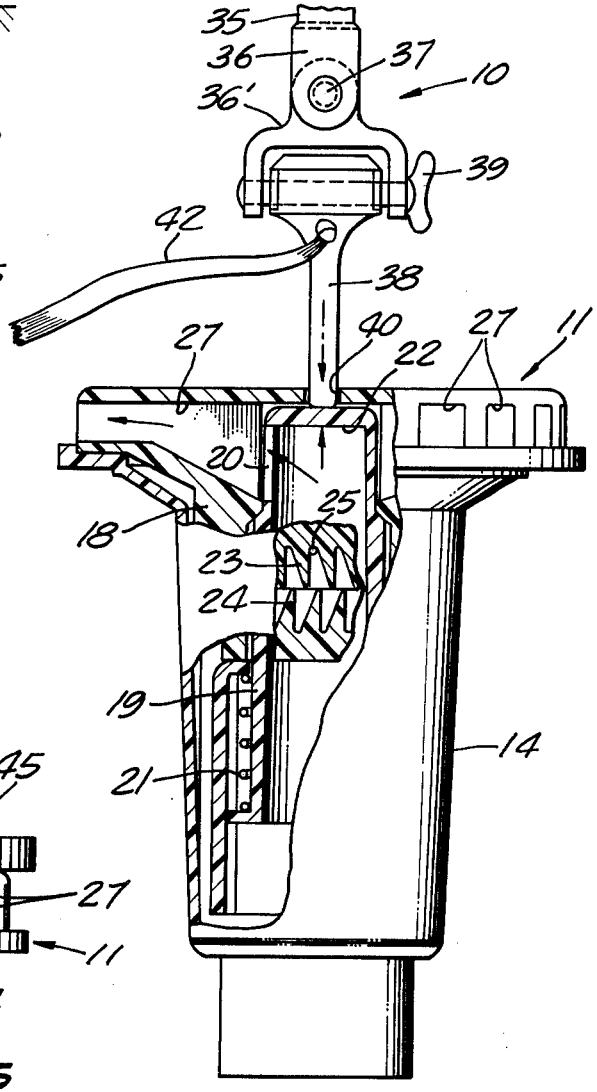
FIG. 2 is an enlarged elevational view of one of the turbo heads in FIG. 1 with portions of the turbo head broken away and with the indexing mechanism thereof about to be actuated by one of the service tools.

Turbo head 11 is disclosed in the patent to William O. Baker U.S. Pat. No. 3,506,489, granted Apr. 14, 1970. Accordingly, the full details of that construction need not be described here beyond the point required for an understanding of its operation. The main housing 18 of unit 10 is provided with an indexing mechanism for progressively rotating a hollow plunger 19 having a single radially disposed water outlet port 20 at the upper end of its sidewall. This plunger is reciprocally mounted within main body 18 and is spring biased to its retracted position by a compression spring 21. As shown in FIG. 2, however, the plunger is held in its fully extended position by the system water pressure acting against the closed upper end 22 of the plunger.

The indexing mechanism for stepping the plunger through a small rotary increment includes two annular rings of opposed saw teeth 23,24 surrounding plunger 19. Both sets of saw teeth are stationary and formed interiorly of main body 18 with their pointed ends offset from one another by one half a tooth as is clearly shown in FIG. 2. A pin 25 mounted diametrically of plunger 19 projects beyond the exterior thereof into the space between the two rings of teeth 23,24. When the plunger is extended, as it is in FIG. 2, pin 25 is seated in the trough between adjacent teeth 23. It is readily apparent that if the plunger is axially depressed, the ends of pin 25 will engage the sloping sides of a pair of underlying teeth 24 thereby camming the plunger to rotate clockwise one half the width of water port 20 and until the pin seats in the bottom of the trough between adjacent teeth 23. It is readily apparent that if the plunger is axially depressed, the ends of pin 25 will engage the sloping sides of a pair of underlying teeth 24 thereby camming the plunger to rotate clockwise one half the width of water port 20 and until the pin seats in the bottom of the trough between teeth 24. On the next extension movement of the plunger to its extended position, pin 25 will cooperate with the sloping sides of teeth 23 to cam the plunger by a like amount to align its outlet port 20 fully with the adjacent one of the outlet ports 27 in housing 18.

Figure 3:
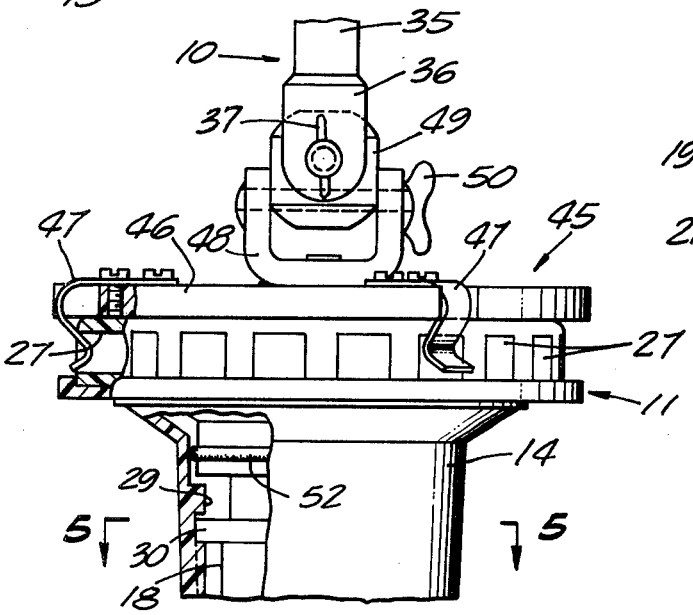
FIG. 3 is a view on an enlarged scale of the second turbo head with a second service tool attached thereto and in readiness to operate the bayonet connection holding the turbo head installed in the pool wall.
Figure 5:
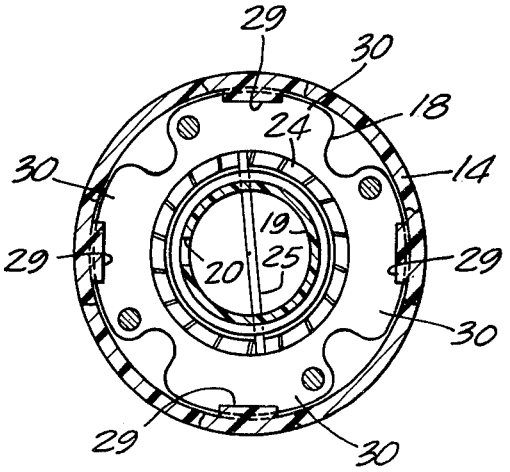
FIG. 5 is a cross-sectional view taken along line 5—5 on FIG. 3 showing details of the bayonet connector.

Referring now to FIGS. 3 and 5, it is pointed out that turbo head 11 is held detachably assembled to the permanently installed conical housing 14 by a bayonet connector comprising tangs 29 projecting radially inwardly from housing 14 and a similar number of cooperating tangs 30 projecting outwardly from the main body 18 of the turbo head. Tangs 30 are interrupted or notched at intervals for a sufficient distance to receive tangs 39 when the turbo head is rotated through an angle of approximately 45° and then shifted axially of housing 14.

Service tool 10 has a long rigid handle 35 provided at its lower end with a pair of yokes 36, 36' held assembled to one another as by a thumb nut fastener 37. A first service tool may be connectable to this yoke to operate the turbo head indexing mechanism comprising an elongated pin 38 pivotally connected to yoke 36 by a thumb nut fastener 39. The end of pin 38 is insertable through an axial opening 40 in the turbo head overlying the closed end 22 of plunger 19. Secured to pin 38 is a flexible strand 42 sufficiently long to extend into the stream of water issuing from one of the ports 27 of the turbo head.

If the user wishes to index the turbo head to align outlet port 20 with a different one of the turbo head outlet passages 27 while the turbo head is in operation, he merely inserts pin 38 downwardly through opening 40 and depresses the plunger in opposition to spring 21 and the water pressure until indexing pin 25 fully seats in the trough between teeth 24. The tool is then allowed to move back as the water pressure acts to extend the plunger to the position shown in FIG. 2. During this reverse plunger movement pin 25 cooperates with teeth 23 to index the plunger into full alignment with the next adjacent one of passages 27. The tool 38 may be reciprocated any number of times to index the plunger to successive ones of the outlet passages 27 thereby to jet a high velocity stream of water across successive areas of the pool wall surrounding the turbo head.

The particular one of the ports in use at a given time is readily ascertained because the issuing stream of water entrains the flexible strand 42 into alignment with the water jet. If the strand happens to be positioned out of alignment with the water jet the tool handle 35 may be rotated about is axis until the operator observes that the strand is picked up by the water jet whereupon the undulation thereof indicates to the workman the particular port through which the water is then issuing.

Figure 4:
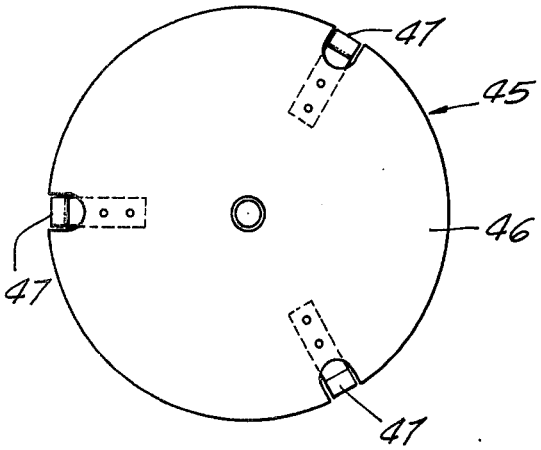
FIG. 4 is a view on a reduced scale taken from the underside of the service tool shown in FIG. 3.

A second service tool, shown in FIGS. 3 and 4, is designated generally 45. As there shown, this tool comprises a disc 46 slightly larger in diameter than the exposed end of the turbo head 11. Secured in peripheral notches at spaced points about this disc are a plurality of spring fingers or clips 47 shaped as best shown in FIG. 3 so that hook shaped ends thereof will seat in the outer end of one of the outlet passages 27. Disc 46 is equipped with a yoke 48 fixed to its center and includes a short cylindrical connector 49 held pivotally supported in yoke 48 by a thumb nut fastener 50. The outer end of connector 49 has a transverse passage loosely accommodating thumb nut fastener 37. This fastener extends through connector 49 at right angles to fastener 50 and cooperates with fastener 50 to provide a universal connection between disc 46 and yoke 36 of handle 35.

Tool 45, when attached to handle 35, is used to disconnect and reconnect the turbo head to housing 14. These purposes are served by assembling tool 45 to the handle and then lowering the disc over the outer end of the turbo head 11 and pressing it firmly thereagainst until the spring clips 47 engage with the underlying ones of the water outlet passages 27. Handle 35 and disc 46 may now be rotated about to disengage the bayonet connector tangs 29, 30 whereupon the tool is withdrawn to lift the turbo head out of housing 14. The turbo head preferably includes a sealing gasket or an O-ring 52 having a snug fit with the juxtaposed interior surface of housing 14 as best shown in FIG. 3. After the turbo head has been serviced it is returned to housing 14 by tool 45 and then rotated as necessary to re-engage the tangs 29,30.

While the particular tool kit for servicing turbo heads herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A tool kit for performing service operations on a swimming pool turbo head of the type having a bayonet disconnect holding said turbo head detachably installed to a swimming pool water supply pipe and of the type having a rotary indexing water outlet port actuatable in steps by a reciprocal plunger housed interiorly of the turbo head, said tool kit comprising: handle means manipulatable from a position at pool side and having separable coupling means at one end thereof;

first tool means detachably connected to said coupling means and provided with gripping means telescopically engageable with the outer end of said turbo head whereby said handle means can be manipulated to disconnect and reconnect the bayonet connection of said turbo head for the servicing thereof; and second tool means detachably connected to said coupling means in lieu of said first tool means and including pin means for engaging and depressing said spring-biased plunger of said turbo head to index said water outlet port to a different water-dispensing position each time said plunger is depressed.

2. A tool kit as defined in claim 1 characterized in that said coupling means on said handle means includes universal joint means.

3. A tool kit as defined in claim 1 characterized in that said turbo head gripping means of said first tool means includes a plurality of resilient fingers engagable over the rim edge of the outer end of said turbo head and into respective ones of a plurality of water outlet passages thereabout.

4. A tool kit as defined in claim 1 characterized in that said second tool means includes a long flexible streamer positioned to be entrained into the path of water discharging from one of a plurality of said water outlet passages of a turbo head thereby to indicate the particular one of said passages then in use.

5. A service tool for connecting and disconnecting a swimming pool turbo head with respect to a submerged water outlet therefor in the wall of a swimming pool and which turbo head is of the type having a ring of radially disposed tubular water outlet passages about the outer end thereof and a housing held assembled to a pool wall by a bayonet connector, said tool comprising:

a handle having pivotable coupling means at the outer end thereof; and a disconnect tool mounted on said coupling means including resilient means for camming over the outermost ends and entering selected ones of said water outlet passages whereupon said handle is manipulatable to rotate said turbo head into and out of the assembled relation of said bayonet connector for withdrawal or insertion of said turbo head with respect to said submerged water outlet.

6. A service tool for manually indexing a submerged swimming pool turbo head from a pool deck to jet water in any one of a multiplicity of generally radial directions and which turbo head is of the type having a ring of generally radially disposed water jetting passages the inlet ends of any one of which can register with a pressurized water outlet port in the sidewall of a reciprocable plunger concealed within said turbo head and indexable from one jetting passage to another upon each complete reciprocal cycle of said plunger; said tool comprising:

a long handle having universal coupling means at the outer end thereof; and exposed elongated pin means attached to said universal coupling means insertable through an opening in a turbo head in axial alignment with said indexable plunger and operatable from the remote end of said handle to reciprocate said plunger to align said water outlet port with a different one of said water jetting passages.

* * * * *